United States Patent [19]

Matsuoka

[11] Patent Number: 4,619,196

[45] Date of Patent: Oct. 28, 1986

[54] TABLET PRINTING DEVICE WITH ORIENTING BRUSH

[75] Inventor: Hikoji Matsuoka, Osaka, Japan

[73] Assignee: Matsuoka Machinery Works Co., Ltd., Osaka, Japan

[21] Appl. No.: 656,735

[22] Filed: Oct. 1, 1984

[30] Foreign Application Priority Data

Oct. 3, 1983 [JP] Japan ..... 58-185472

[51] Int. Cl.[4] ..... B41F 17/36

[52] U.S. Cl. ..... 101/35; 198/384

[58] Field of Search ..... 198/384, 385, 386, 387; 101/35, 40

[56] References Cited

U.S. PATENT DOCUMENTS

| | | | |
|---|---|---|---|
| 2,232,208 | 2/1941 | Carroll | 198/385 X |
| 2,528,293 | 10/1950 | Ashlock, Jr. | 198/384 |
| 2,732,987 | 1/1956 | Moore | 198/384 |
| 3,024,889 | 3/1962 | Reading | 198/387 |
| 3,212,545 | 10/1965 | Aguilar | 198/384 X |
| 3,889,591 | 6/1975 | Noguchi | 101/37 |
| 4,321,729 | 3/1982 | Ollik | 198/385 X |

*Primary Examiner*—Clifford D. Crowder

*Attorney, Agent, or Firm*—Wenderoth, Lind & Ponack

[57] ABSTRACT

A tablet printing device includes a hopper, a rotary cylinder, a printing roller and a chute. A brush for rectifying the posture of a tablet in a recess of the rotary cylinder moves laterally at a right angle in relation to the direction of rotation of the rotary cylinder and applies lateral torque to the tablet in the recess. The brush is located between the hopper and the printing roller so as to ensure that all tablets are positioned in the recesses in a normal posture.

1 Claim, 7 Drawing Figures

TABLET PRINTING DEVICE WITH ORIENTING BRUSH

BACKGROUND OF THE INVENTION

1. Field of the Invention

This invention relates to a device for printing letters, marks and the like on tablets or capsules (hereinafter referred to as tablets).

2. Prior Art

A tablet printing device of the construction shown in FIG. 2, for example, is well known. This tablet printing device 1 comprises a rotary cylinder 2, a hopper 10 above said cylinder 2, a printing roller 11 and a chute 15 below the cylinder 2. The rotary cylinder 2 has at its periphery many recesses 3 in which tablets T are received. The rotary cylinder 2 is provided with air holes which open to one side and each air hole 4 is connected to a nozzle hole 5 which opens to a recess 3, as shown in FIG. 4. Numeral 6 in FIG. 3 is a plate for air distribution which is in tight contact with the rotary cylinder 2 and communicates with a vacuum device and a source of pressurized air (these are not shown in the drawing). Plate 6 has a groove opposed to the air holes 4. By this arrangement, the recesses 3 are subjected to sucking action by the vacuum device while they move from the exit of the hopper 10 to the inlet of the chute 15 but are subjected to discharge action by pressurized air while they are opposed to the chute 15.

Printing roller 11 comprises, as an example, a printing type roller 12 having the required letters, marks or the like which project from its periphery and a transfer roller 13 which is made of elastic material, such as rubber, and makes contact with the printing type roller 12. Printing type of printing type roller 12 are supplied with ink from an ink tank 14 and ink on the printing type is transferred to the transfer roller 13, which prints the surfaces of tablets. In this case, if a table T is flat and has an even surface C at its side, such tablet sometimes will not be received accurately in the recess 3. As shown in FIG. 4, a tablet Ta is received in a recess 3 in a regular state, but a tablet Tb is received in a recess 3 in a abnormal state, namely, received in the recess at a right angle in relation to the tablet Ta. Both of the tablet Ta and the table Tb are carried to the transfer roller 13 in the positions shown in the drawing and then are printed. This means that the tablet Tb is printed at its side or sucking action is not applied fully to the Tablet Tb, with the result that the tablet Tb falls off the rotary cylinder 2 and is sandwiched between the rotary cylinder 2 and the transfer roller 13, thus causing operating problems.

In any case, it is not desirable that the tablets T be received in the recesses 3 in abnormal states and it is necessary to have all tablets received in regular positions in the recesses. However, it is very difficult to ensure that all tablets are received accurately in the recesses.

SUMMARY OF THE INVENTION

The object of the present invention is to eliminate the above difficulties, namely, to ensure by simple means that all tablets are received in the recesses in the regular state or position.

BRIEF DESCRIPTION OF THE DRAWINGS

The present invention is described below with reference to a preferred embodiment shown in the drawings, in which.

DETAILED DESCRIPTION OF THE INVENTION

Figure 5:
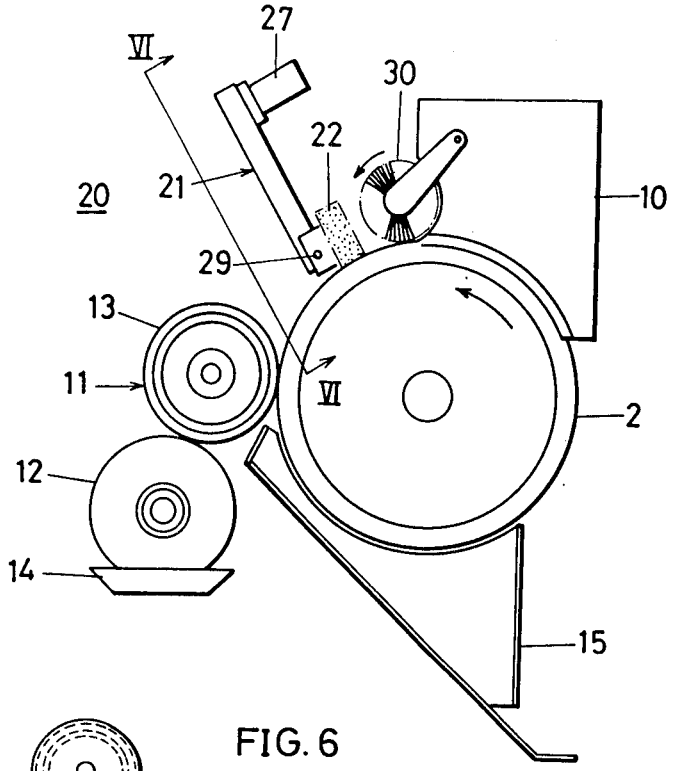
FIG. 5 is a front view of a tablet printing device according to the present invention.
Figure 6:
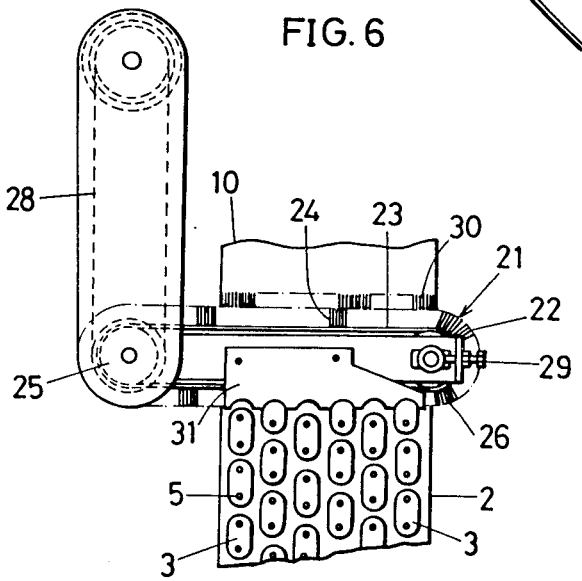
FIG. 6 is a cross section taken along the line VI—VI in FIG. 5.

The present invention is described below with reference to FIG. 5 and FIG. 6.

Figure 2:
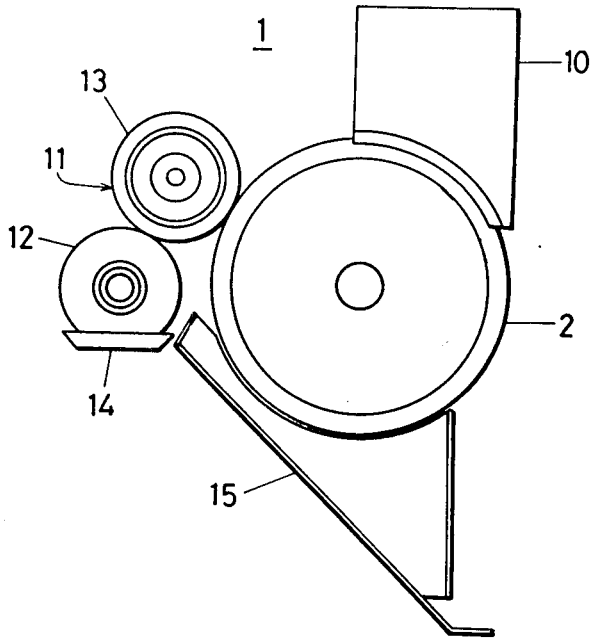
FIG. 2 PRIOR ART
FIG. 2 is a front view of main parts of a conventional device.
Figure 1A:
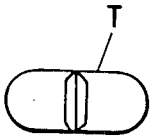
FIGS. 1A and 1B respectively are a plan view and a front view of a tablet.
Figure 1B:
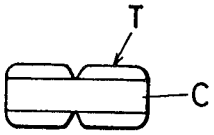
Figure 3:
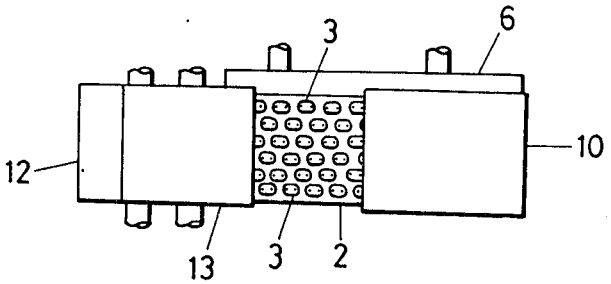
FIG. 3 PRIOR ART
FIG. 3 is a plan view of the device shown in FIG. 2.

The tablet printing device 20 is provided with a rotary cylinder 2, a hopper 10, a printing roller 11 and a chute 15. The construction and the action of these parts are similar to those of the conventional device shown in FIG. 2. Therefore, like reference characters designate like or corresponding parts and explanation of them is omitted.

Numeral 21 denotes a posture rectifying means provided between the hopper 10 and the transfer roller 13 of the printing roller 11. This means 21 has a rotary brush 22 which is opposed to the upper surface of the rotary cylinder 2. This rotary brush 22 includes hairs of bristles positioned on an endless belt 23 which is stretched between pulleys 25 and 26. These pulleys 25, 26 extend in planes parallel with the axial center of the rotary cylinder 2, and the rotary brush 22 is stretched over the entire width of the rotary cylinder 2. The rotary brush 22 is driven by a variable speed motor 27 via an interlocking mechanism 28 and is rotated at a proper speed in a direction extending at a right angle to the direction of rotation of the rotary cylinder 2 and parallel to the axis of rotation of rotary cylinder 2. Numeral 29 is a mechanism to regulate the tension of the rotary brush 22 by moving the driven pulley 26. In FIG. 6, numeral 30 denotes a brush for regulating feeding of the tablets provided at the exit side of the hopper 10 over the entire width of the rotary cylinder 2. Bristles of brush 30 contact the surface of cylinder 2 and move in a direction opposite to the direction of movement of the rotary cylinder 2 so as to comb up or push back into hopper 10 those tablets which are not received in recesses 3, allowing only those tablets received in the recesses 3 to pass between cylinder 2 and brush 30. Numeral 31 is a plate to keep the rotary brush 22 from following the rotary cylinder 2 in rotation.

In the above-mentioned construction, tablets T are first put in the hopper 10. With the rotation of the rotary cylinder 2, some of the tablets T are received in the recesses 3 but other tablets T which are not received in the recesses 3 and move with the rotary cylinder 2 are returned into the hopper 10 by means of the brush 30 for regulating feeding of the tablets.

Figure 4:
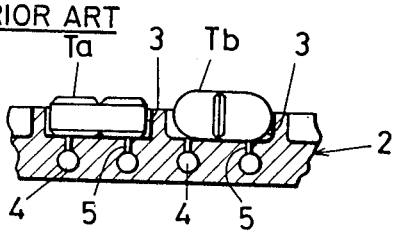
FIG. 4 PRIOR ART
FIG. 4 is an explanatory view showing the positions state of tablets are received in recesses of the rotary cylinder of FIG. 2.

Tablets T in the recess 3 are held by suction from the vacuum device connected to the air hole 4 (refer to FIG. 4) and reach the undersurface of the rotary brush 22. In this case, since tablets Ta which are positioned in the recesses 3 in a normal state (refer to FIG. 4) are subjected to satisfactory suction and project only slightly from the recesses 3, they are prevented from moving from recesses 3 due to rotation of the rotary cylinder 2.

On the other hand, since tablets Tb which are positioned in the recesses 3 in an abnormal state (refer to FIG. 4) are not subjected to satisfactory suction and project from the recesses 3 by a greater amount, they are subjected to torque in the lateral direction by the lateral movement of the rotary brush 22 and thus their posture in the recesses 3 is rectified to a normal state.

As described above, according to the present invention there is provided a rotary brush which moves at a right angle in relation to the rotating direction of a rotary cylinder. Therefore, tablets which are received in the recesses on the periphery of the rotary cylinder in an abnormal state are subjected to torque in the lateral direction by means of the rotary brush and are rectified or reoriented to a normal state in the recesses. Thus, the present invention makes it possible to print regular or intended portions of tablets accurately by a simple structural arrangement.

Since the hairs or bristles of the endless belt of the rotary brush may be made of rubber or special feathers, the tablets are not stained or damaged during the printing process.

I claim:

1. In a tablet printing device comprising a rotary cylinder having peripheral recesses, a hopper for supplying tablets into said recesses, and printing roller means opposed to said rotary cylinder for printing tablets within said recesses, the improvement of means ensuring that all said tablets printed by said printing roller means are oriented in respective said recesses in a normal posture to be printed properly, said ensuring means comprising:

a pair of spaced pulleys;

an endless belt extending around and between said pulleys, said belt extending across the entire width of the periphery of said rotary cylinder;

bristles extending from said endless belt for contact with said tablets in said recesses; and means for moving said belt across said periphery of said rotary cylinder in a direction extending at a right angle to the direction of rotation of said rotary cylinder and parallel to the axis of rotation of said rotary cylinder, and thereby for causing said bristles to impart lateral forces to said tablets and thus to reorient any said tablet from an incorrect posture within said respective recess to said normal posture therein.

* * * * *